US007781955B2

(12) United States Patent
Kitamura

(10) Patent No.: US 7,781,955 B2
(45) Date of Patent: Aug. 24, 2010

(54) IMAGE DISPLAY DEVICE

(75) Inventor: Shin Kitamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 271 days.

(21) Appl. No.: 11/764,365

(22) Filed: Jun. 18, 2007

(65) Prior Publication Data

US 2008/0001521 A1 Jan. 3, 2008

(30) Foreign Application Priority Data

Jun. 30, 2006 (JP) ..... 2006-181283

(51) Int. Cl.
*H01J 63/04* (2006.01)

(52) U.S. Cl. ..... 313/496; 313/495

(58) Field of Classification Search ..... 313/495–498
See application file for complete search history.

(56) References Cited

U.S. PATENT DOCUMENTS

| | | | | |
|---|---|---|---|---|
| 5,185,554 | A | 2/1993 | Nomura et al. | 313/495 |
| 6,121,942 | A * | 9/2000 | Sanou et al. | 345/75.1 |
| 6,184,626 | B1 * | 2/2001 | Oda | 315/169.1 |
| 6,288,494 | B1 * | 9/2001 | Tsukamoto et al. | 315/169.1 |
| 6,624,589 | B2 | 9/2003 | Kitamura et al. | 315/169.3 |
| 6,843,696 | B2 | 1/2005 | Kitamura et al. | 445/24 |
| 6,848,962 | B2 | 2/2005 | Kitamura et al. | 445/24 |
| 6,933,664 | B2 * | 8/2005 | Kitamura et al. | 313/309 |
| 7,131,886 | B2 | 11/2006 | Kitamura et al. | 445/51 |
| 7,198,966 | B2 | 4/2007 | Kitamura et al. | 438/20 |
| 2003/0001477 | A1 * | 1/2003 | Sasaguri | 313/310 |
| 2005/0134161 | A1 | 6/2005 | Kitamura et al. | 313/309 |
| 2006/0082289 | A1 * | 4/2006 | Yeh et al. | 313/504 |
| 2006/0091780 | A1 * | 5/2006 | Minami | 313/495 |
| 2007/0103052 | A1 * | 5/2007 | Jeng et al. | 313/497 |
| 2007/0188067 | A1 | 8/2007 | Tsukamoto et al. | 313/309 |
| 2007/0190672 | A1 | 8/2007 | Kitamura et al. | 438/20 |

FOREIGN PATENT DOCUMENTS

| | | |
|---|---|---|
| JP | 3-20941 | 1/1991 |
| JP | 9-330676 | 12/1997 |
| JP | 2000-215789 | 8/2000 |
| JP | 2003-68192 | 3/2003 |

* cited by examiner

*Primary Examiner*—Joseph L Williams
*Assistant Examiner*—Brenitra M Lee
(74) *Attorney, Agent, or Firm*—Fitzpatrick, Cella, Harper & Scinto

(57) ABSTRACT

There is provided an image display device which can prevent a charge-up occurring on the surface of an insulation substrate with a simple constitution even if any antistatic film is not provided. In the image display device which includes an electron-emitting device on an insulation layer on the substrate, there is provided a conductive layer which is an orthogonal projection region of an anode electrode and includes a predetermined metal kind directly below an exposed surface of the insulation layer.

7 Claims, 14 Drawing Sheets

IMAGE DISPLAY DEVICE

BACKGROUND OF THE INVENTION

1. Field of the Invention

The present invention relates to an image display device which includes an electron-emitting device and an anode substrate into which an electron beam from the electron-emitting device enters.

2. Description of the Related Art

As electron-emitting devices, there are an electron-emitting device of field emission (FE) type, an electron-emitting device of metal-insulator-metal (MIM) type, a surface-conduction electron-emitting device, and the like. Further, it has been proposed to constitute an image display device by providing anode electrodes opposed to an electron source that a large number of electron-emitting devices are disposed on an insulation substrate (see Japanese Patent Application Laid-Open Nos. H09-330676, 2000-215789, H03-020941, and 2003-068192).

In the above image display device, if an insulation portion of the insulation substrate on which the electron-emitting devices are disposed is exposed, a charge-up occurs on the exposed portion. Then, if any countermeasure against the charge-up is not adopted, there is a fear that it is difficult to stably drive the electron-emitting devices for a long time. Also, there is a fear that an electron emission characteristic changes time-dependently because an orbit of an electron beam emitted from the electron-emitting device is confused.

As disclosed in Japanese Patent Application Laid-Open No. 2003-068192, for example, it is necessary to provide, as a means for decreasing an influence due to the charge-up like this, a means for covering the surface of the insulation substrate with a high-resistance film such as an antistatic film.

Besides, each of Japanese Patent Application Laid-Open Nos. H09-330676, 2000-215789 and H03-020941 discloses such an image display device as described above.

Incidentally, if the antistatic film is disposed to prevent the surface of the insulation substrate from being charged, manufacturing processes of the image display device such as a film forming process, a patterning process and the like may often increase, and these process may be often complicated. In addition, there is a probability that, for example, if the material of the antistatic film is attached to the electron emission portion on the electron-emitting device, the electron emission characteristic changes.

SUMMARY OF THE INVENTION

The present invention aims to provide an image display device which can prevent a charge-up occurring on the surface of an insulation substrate with a simple constitution even if any antistatic film is not provided.

That is, the present invention is characterized by an image display device which comprises: (A) a first substrate which includes an insulation layer and an electron-emitting device provided on the insulation layer; and (B) a second substrate which includes an anode electrode disposed opposed to the electron-emitting device and a light emission layer, and is disposed opposed to the first substrate, wherein a conductive layer is disposed directly below at least a part of an exposed surface of the insulation layer within a region on the first substrate opposed to the anode electrode, and the conductive layer includes metals selected from at least two respective groups of a first group consisting of metals belonging to the third period of the periodic table of elements, a second group consisting of metals belonging to the fourth period of the periodic table of elements, and a third group consisting of metals belonging to the fifth and sixth periods of the periodic table of elements.

In addition, the present invention includes the following constitutions as exemplary embodiments.

That is, the conductive layer includes the metals selected respectively from the first group, the second group and the third group.

Further, the light emission layer includes a fluorescent member mainly containing ZnS and a fluorescent member mainly containing $Y_2O_2S$, and the conductive layer includes at least one kind selected from among Al, Ni, Fe and Ti and at least one kind selected from among Pt and Ta.

According to the present invention, since the conductive layer is disposed directly below at least a part of the exposed surface of the insulation layer exposed around the electron-emitting device, a charge-up nearby the electron-emitting device can be prevented when the image display device is driven, whereby it is possible to acquire a stable irradiation current, and it is thus possible to provide the image display device which is excellent in a display characteristic.

Further features of the present invention will become apparent from the following description of exemplary embodiments with reference to the attached drawings.

DESCRIPTION OF THE EXEMPLARY EMBODIMENTS

First, the principle of the present invention will be described.

Figure 2:
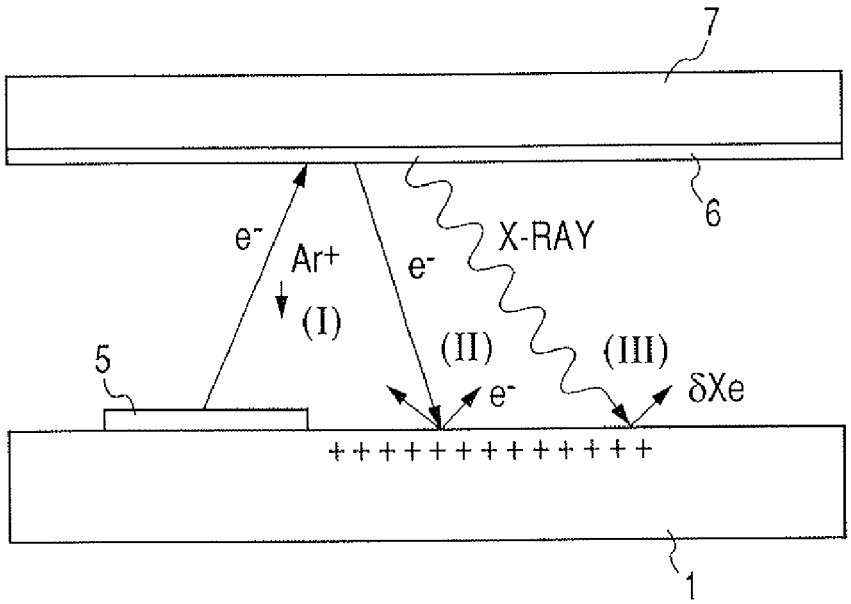
FIG. 2 is a schematic cross-sectional view for describing the charge inside the image display device according to the present invention.

FIG. 2 is a schematic cross-sectional view for describing the charge inside an image display device according to the present invention. An insulation substrate (rear plate) 1, an electron-emitting device 5, a substrate 7 and an anode electrode 6 are illustrated in FIG. 2. A space between the substrate 7 and the substrate 1 is maintained to become such the pressure lower than the atmospheric pressure (ideally, it should be maintained to be a vacuum). Note that although a light emitter such as a fluorescent member or another member other than the anode electrode 6 is provided on a side of the substrate 7 in the image display device, such the light emitter is omitted in FIG. 2 for convenience in order to simplify the description.

As factors of the charge on a surface of the insulation substrate 1 on which the electron-emitting device 5 is arranged, the following factors are considered in principle as illustrated in FIG. 2.

(I) The gas existing inside the image display device is ionized by an electron beam from the electron-emitting device 5, and the generated ions is bombarded to the substrate.

(II) Secondary electrons are generated due to a fact that the reflected electrons, which are generated by that the electron beam is irradiated to the anode electrode 6, enters into the substrate 1.

(III) Photoelectrons are generated (photoelectric effect) due to a fact that the X-rays generated when the electron beam collides with the anode electrode 6 enter into the substrate.

The present inventor traced that the generation of photoelectrons due to the X-rays mentioned in the item (III) greatly contributes to the charge on the substrate 1 among the above-mentioned factors of the charge.

When the X-rays (photons) enter into the substance (structural material of the substrate 1), the entered (i.e., incident) X-rays attenuate by the interaction with the substance (structural material of the substrate 1). A degree of this attenuation varies according to the substance or the energy intensity of the photons.

When the photons quantity to be entered is assumed as 10, the photons quantity I at a position defined by the depth t in the substance is expressed by the following expression.

$$I=I0\cdot\exp(-t/\mu) \tag{1}$$

Here, a value of the X-ray attenuation length μ for each the substance is fixed by the substance, the photon energy and an incident angle.

Meanwhile, a moving distance R of an electron which moves inside the substance is expressed by the following expression.

$$R=250(A/\rho)(E/Z^{0.5})^n$$

$$n=1.2/(1-0.29\mathrm{Log}Z) \tag{2}$$

Here,

A: a mean atomic number

ρ: mass density

Z: number of electrons per one molecule

E: electron energy

An escaping degree δXe of the photoelectrons, which were generated when the X-rays entered into the substance, from a surface of the substance is expressed by the following expression.

$$\delta Xe=(R/\mu)/4 \tag{3}$$

If the electrons are not supplied after the electrons were vanished from the substrate 1, the positive charge depending on a degree indicated by the above-mentioned expression (3) generates on a surface of the substrate 1.

Therefore, the insulation portions, which are exposed in order to electrically separate a conductive member from other conductive members, to which the different potential are respectively supplied, such as the electron-emitting devices and wirings provided on the substrate 1, are positively charged.

Figure 1:
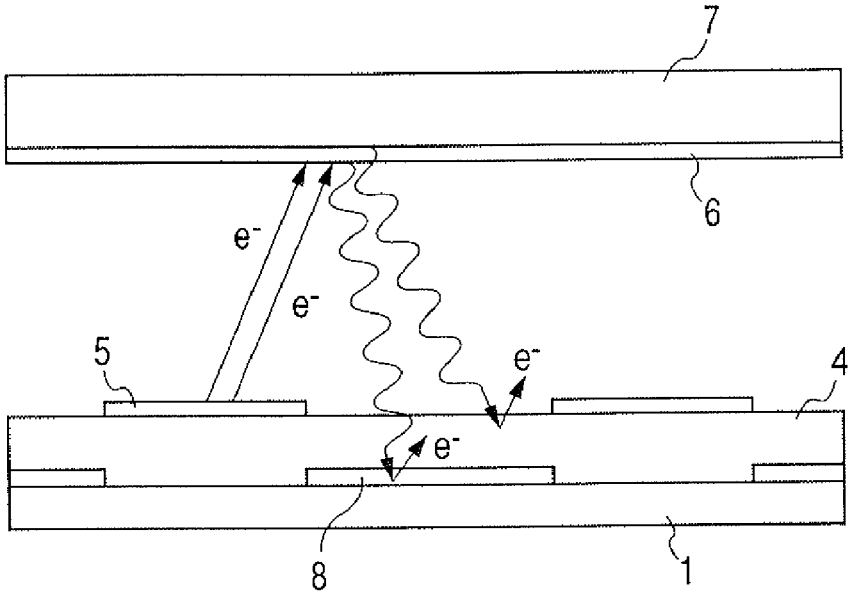
FIG. 1 is a schematic cross-sectional view illustrating the basic structure of an image display device according to the present invention.

In order to reduce the charge, in the present invention, a conductive layer 8 is provided just under at least one portion of a surface of an insulation layer 4 to be exposed for the anode electrode 6 as illustrated in FIG. 1, and the electrons are entered into the insulation layer 4, from which the electrons are vanished due to the above-mentioned photoelectric effect, from the conductive layer 8 at a lower position by using the photoelectric effect.

In this description, an example, where the substrate 1 and the insulation layer 4 are structured by different members, was indicated. However, the substrate 1 and the insulation layer 4 may not be structured by the different members. That is, such the form of implanting the conductive layer 8 into the insulation substrate 1 is also allowed.

Next, a charge suppressive effect on a surface of the insulation substrate 1 according to the present invention will be described.

As illustrated in FIG. 1, in the structure of arranging the conductive layer 8 just under an exposed surface of the insulation layer 4 for the anode electrode 6, the electron quantity vanished from the insulation layer 4 by the irradiation of photons and the electron quantity emitted from the conductive layer 8 at a lower position by the irradiation of photons are respectively estimated by the following expressions.

When t(Ins)<R(Ins), $$Ge(Ins)=Ie\{1-\exp(-t(Ins)/\mu(Ins))\} \tag{4}$$

When t(Ins)≧R(Ins), $$Ge(Ins)=Ie\{1-\exp(-R(Ins)/\mu(Ins))\} \tag{5}$$

When t(con)<R(con), $$Ge(con)=(Ie-Ge(Ins))\cdot\{1-\exp(-t(con)/\mu(con))\} \tag{6}$$

When t(con)≧R(con), $$Ge(con)=(Ie-Ge(Ins))\cdot\{1-\exp(-R(con)/\mu(con))\} \tag{7}$$

Here,

Ge(Ins.): the electron quantity vanished from the insulation layer 4 by the irradiation of photons Ge(Con.): the electron quantity emitted from the conductive layer 8 at a lower position by the irradiation of photons Ie: the photon quantity entered to a surface of the insulation layer 4 from the anode electrode 6.

t: thickness of respective layers

R: an electron range of respective electrons

Here, in order to simplify the expressions, an incident angle of the photon entered from the anode electrode 6 is regarded as 90° and the number of electrons generated by the photoelectric effect per one photon is regarded as one.

Figure 3A:
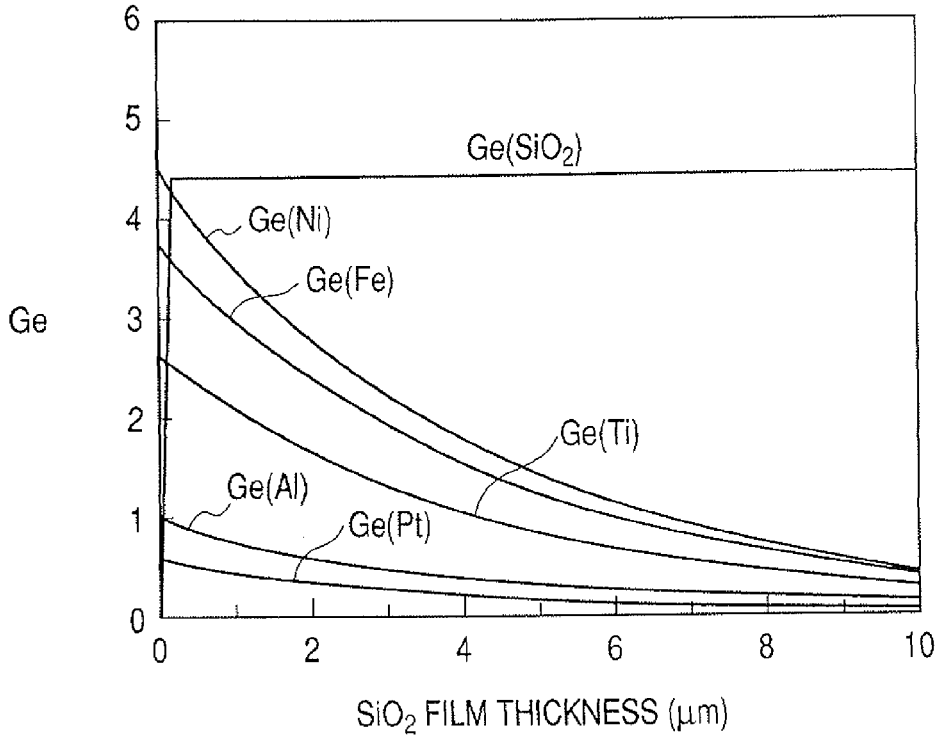
FIGS. 3A and 3B are views indicating the change of charge amount on a surface of an insulation layer due to the material of a conductive layer.
Figure 3B:
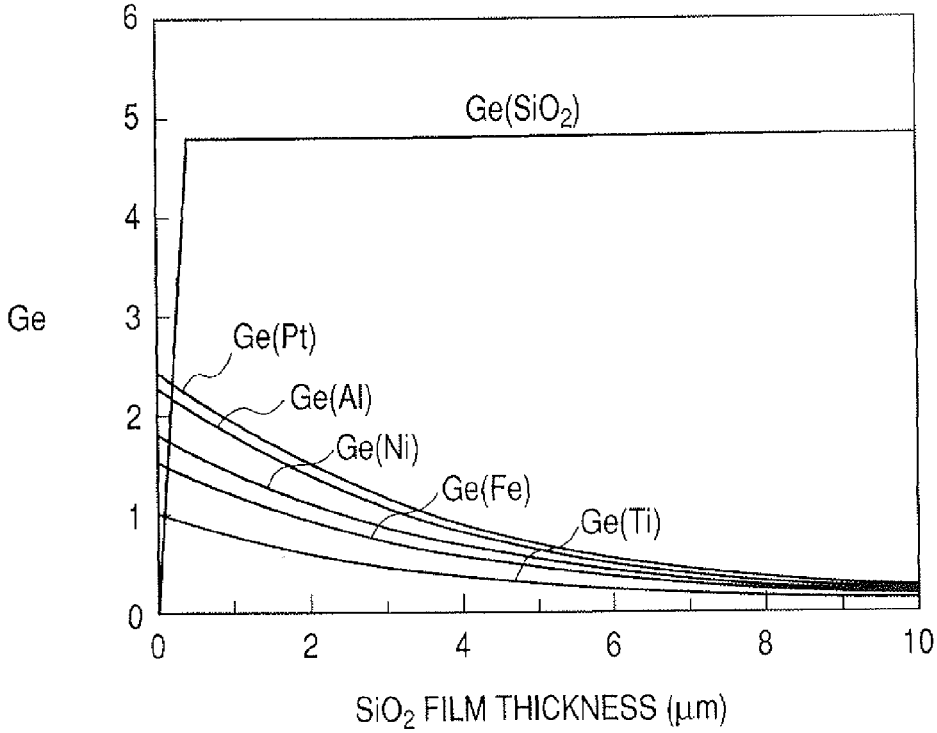

Based on a estimating method of the charge amount as above mentioned, it is illustrated in FIGS. 3A and 3B that how a degree of the charge on a surface of the insulation layer 4 changes depending on the material of the conductive layer 8 when the thickness of the insulation layer 4 (in this example, oxide silicon) is varied. In examples of FIGS. 3A and 3B, the photon energy is varied.

Since values on longitudinal axes in FIGS. 3A and 3B presuppose the condition in the above-mentioned expressions, those values are slightly different from actual values including absolute values, and there is not a problem in selecting the material of the conductive layer 8 and setting the thickness of the respective layers.

As indicated in FIGS. 3A and 3B, although depending on the photon energy, it is understood that the quantity of electrons ($Ge(SiO_2)$) emitted from the insulation layer 4 is estimated larger than the quantity of electrons (Ge(Metal)) entered into the insulation layer 4 from the conductive layer 8 excepting a case that the thickness of the insulation layer 4 is extremely thin. Accordingly, as the conductive layer 8 at a lower position, it is desirable to select such the material having a large capability of entering electrons as much as possible (that is, a value of the δXe in the expression (3) is larger) in order to obtain the charge suppressive effect on a surface of the insulation layer 4.

Meanwhile, a face plate of the image display device includes at least the anode electrode 6, substrate 7, and the light emitter such as the fluorescent member. Therefore, the electrons emitted from the electron-emitting device are irradiated to not only the anode electrode 6 but also the light emitter. Therefore, in the image display device having such the two kinds of members on a side of the face plate, the photons of at least two kinds of energy are generated from a side of the face plate. In this case, it is important that the conductive layer 8 is structured by combining at least two kinds of materials according to distribution of the energy of photons generated from a side of the face plate in a viewpoint of suppressing the charge on a surface of the insulation layer 4.

Figure 4:
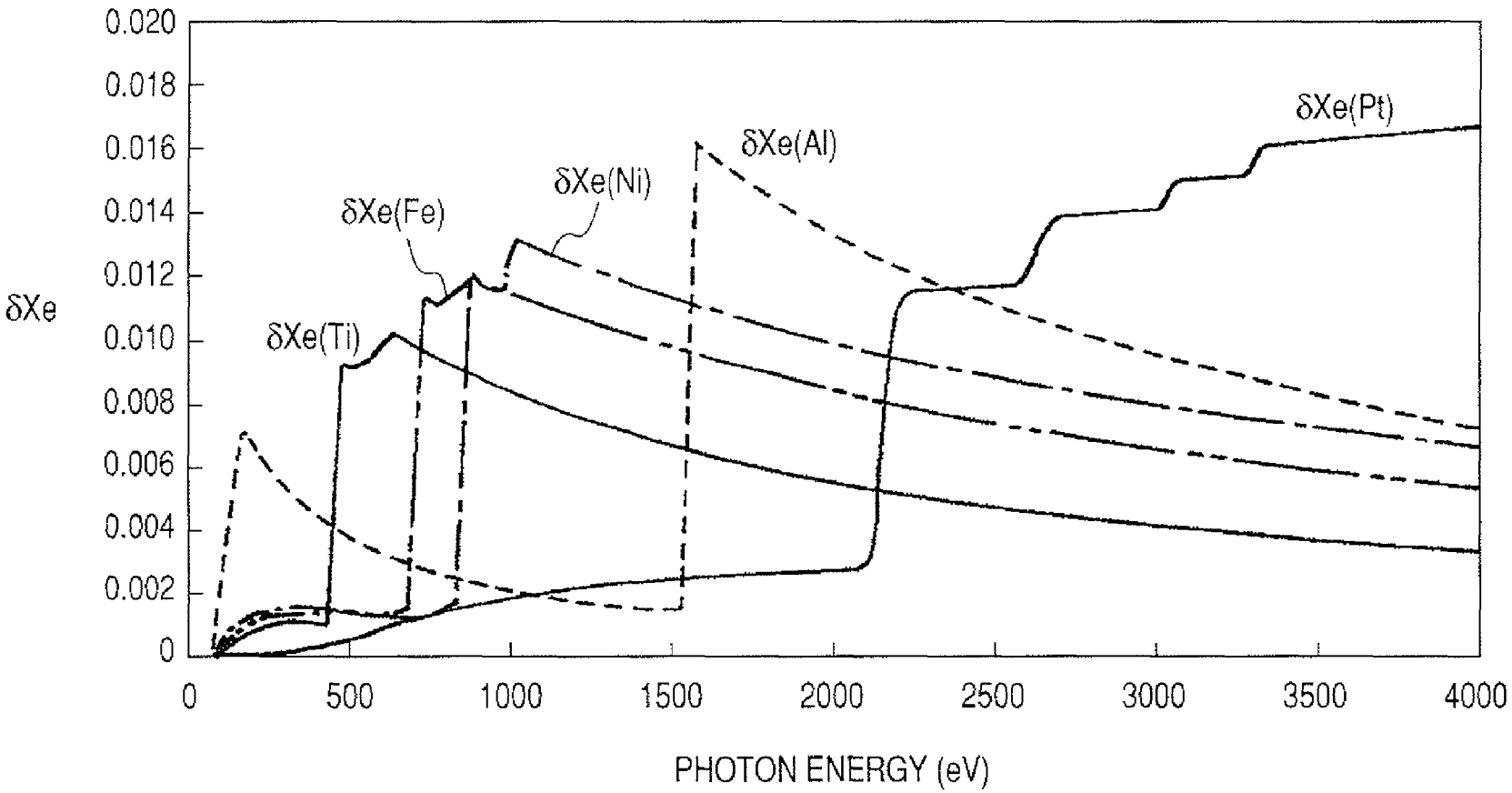
FIG. 4 is a view indicating the δXe (an escaping degree of photoelectrons from a surface of substance) for plural kinds of metals.

For example, if the conductive layer 8 is structured by a combination of Fe, Al and Pt or a combination of Ni, Al and Pt as indicated in FIG. 4, it is understood that the charge suppressive effect of the conductive layer 8 can be obtained for the photons having a wide range of energy. Of course, a combination of Ni, Fe, Al and Pt can be used.

Figure 5:
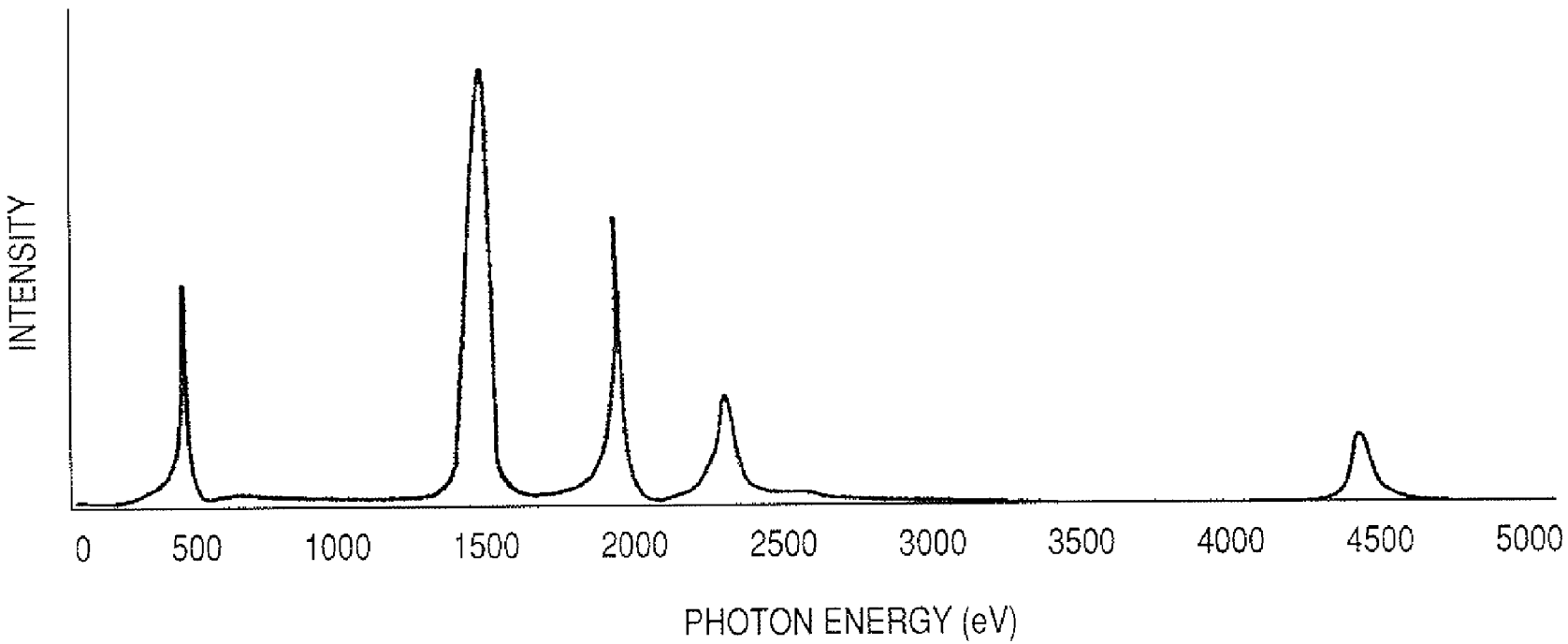
FIG. 5 is a view indicating energy distribution of the X-rays generated from an anode electrode and a fluorescent member when an electron beam is irradiated in an example 2 of the present invention.
Figure 6:
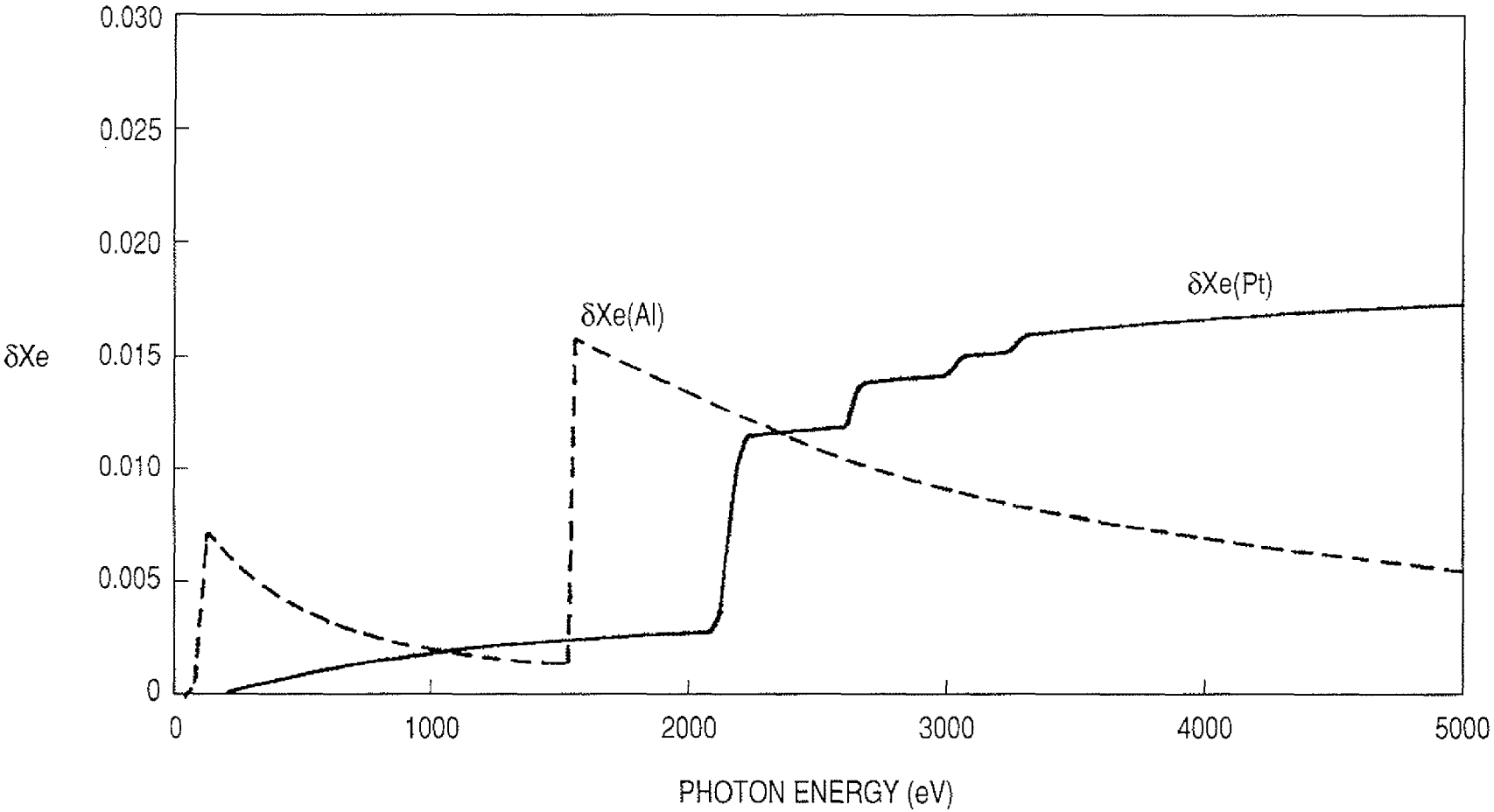
FIG. 6 is a view indicating the δXe for energy of the respective X-rays of the conductive layer in the example 2.

FIG. 5 schematically indicates the energy distribution of photons generated when a voltage of 8 kV is applied to the anode electrode 6 by using a stack member made from Al and Ti as the anode electrode 6 and using $Y_2O_2S$:Eu as the fluorescent member for obtaining the red light emission. The $Y_2O_2S$:Eu is widely and preferably used for a CRT (cathode ray tube). FIG. 6 indicates the δXe for Al and Pt in case of structuring the conductive layer 8 made from two kinds of metals Al and Pt. If using this combination, it is understood that electrons can be supplied to the insulation layer 4 according to photons of respective energy bands generated from a side of the face plate.

Figure 7:
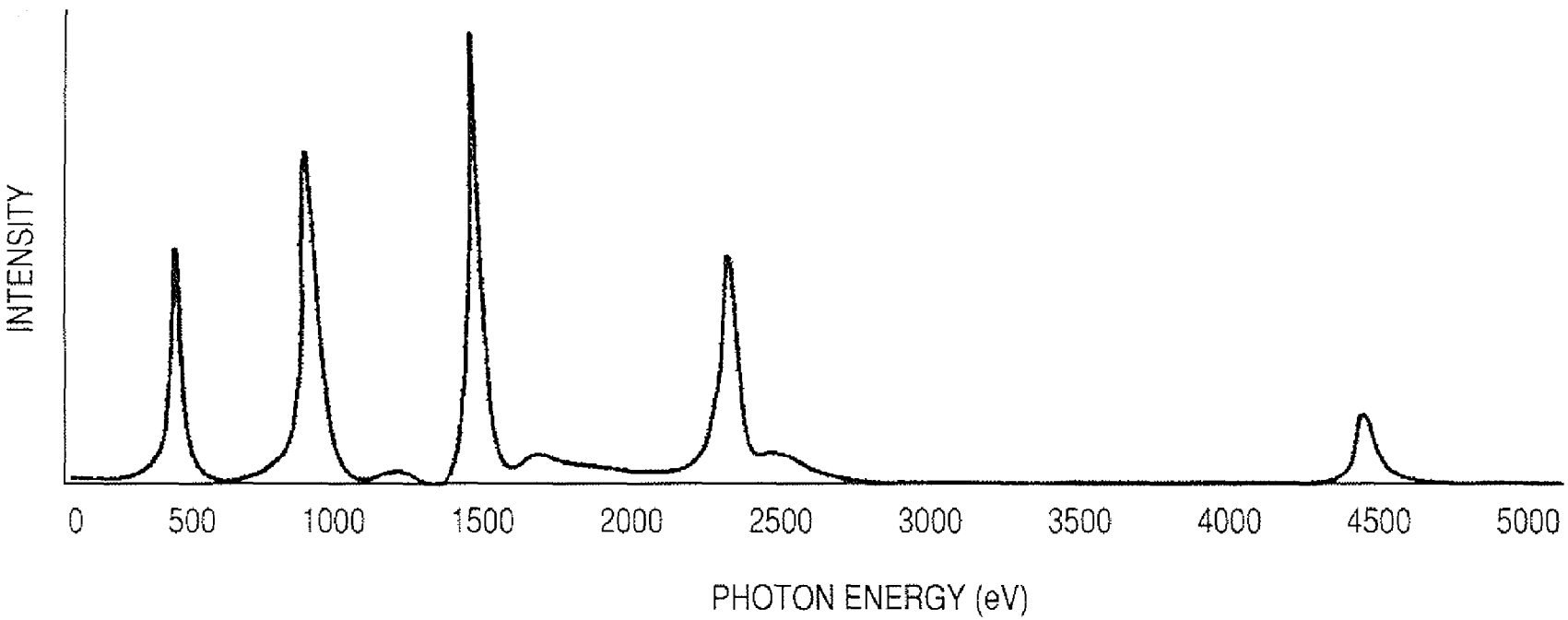
FIG. 7 is a view indicating energy distribution of the X-rays generated from an anode electrode and a fluorescent member when an electron beam is irradiated in an example 1 of the present invention.
Figure 8:
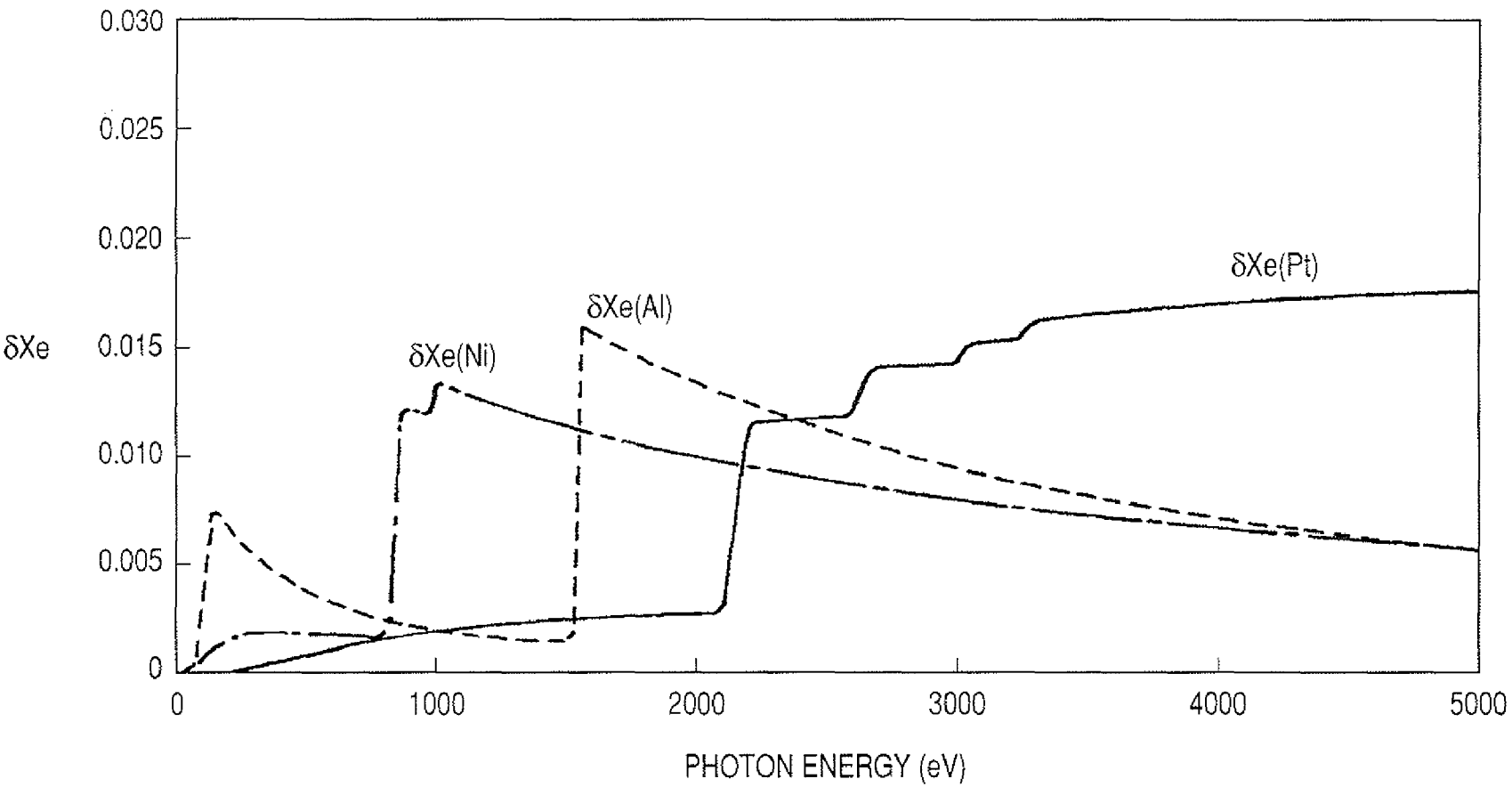
FIG. 8 is a view indicating the δXe for energy of the respective X-rays of the conductive layer in the example 1.

FIG. 7 schematically indicates the energy distribution of photons generated when a voltage of 8 kV is applied to the anode electrode 6 by using the stack member made from Al and Ti as the anode electrode 6 and using ZnS:Cu,Al as the fluorescent member for obtaining the green light emission. The ZnS:Cu,Al is widely and preferably used for the CRT. FIG. 8 indicates the δXe for Ni, Al and Pt in case of structuring the conductive layer 8 made from three kinds of metals Ni, Al and Pt. If using this combination, it is understood that electrons can be supplied to the insulation layer 4 according to photons of respective energy bands.

In this manner, in a case that the face plate which has the anode electrode 6 including at least Al and a fluorescent layer including the fluorescent member of which main components are ZnS and $Y_2O_2S$ is used, the conductive layer 8 including at least three kinds of metals Ni, Al and Pt is used. Accordingly, it is understood that the charge on the insulation layer 4 can be suppressed. As the fluorescent member of which the main component is ZnS, there is another fluorescent member ZnS:Ag which is widely and preferably used for the CRT as the fluorescent member for obtaining the blue light emission. Therefore, when the $Y_2O_2S$:Eu is used as the red light emitter, the ZnS:Ag is used as the blue light emitter and the ZnS:Cu, Al is used as the green light emitter, if the conductive layer made from Ni, Al and Pt is used, the charge on the insulation layer 4 can be suppressed.

Note that since Ni, Fe and Ti, which belong to a fourth period in the periodic table of the elements, have the similar δXe, Fe in the above-mentioned combination can be displaced by Ni or Ti. Of course, the conductive layer 8 structured by a combination of Ni, Fe, Al and Pt, a combination of Ti, Fe, Al and Pt, a combination of Ni, Ti, Al and Pt or a combination of Ni, Fe, Ti, Al and Pt can be also used. In addition, since Pt and Ta, which belong to a sixth period in the periodic table of the elements, have the similar δXe, Pt in the above-mentioned combination can be displaced by Ta, and Ta can be further added to the above-mentioned combination.

In this manner, by structuring the conductive layer 8 by combining at least two kinds of metallic materials which belong to the different periods each other, the charge on the insulation layer 4 can be suppressed.

FIG. 4 indicates values of the δXe for the respective metals. As indicated in FIG. 4, the values of the δXe for the respective materials depend on the photon energy, and it is understood that the materials, of which the values of the δXe become the maximum according to the photon energy, are different each other. The values of the δXe can be roughly classified by the periods, to which the respective metals are belonged, in the periodic table. For example, with respect to Al belonging to a third period, Ni, Fe and Ti belonging to a fourth period, and Pt and Ta belonging to a sixth period, there are the large differences in the photon energy for causing the maximum values of their δXe. That is, the metals belonging to a third period indicate the similar δXe characteristics each other and the metals belonging to a fourth period indicate the similar δXe characteristics each other. Here, note that the metals belonging to a fifth period and the metals belonging to a sixth period also indicate the similar δXe characteristics each other.

Therefore, the conductive layer 8, which includes at least two kinds of metals respectively selected from at least two groups among a first group constituted by the metals belonging to a third period, a second group constituted by the metals belonging to a fourth period and a third group constituted by the metals belonging to fifth and sixth periods, is used. The metals respectively to be selected from these two groups may be one kind of metal, two kinds of metals or more. Accordingly, the charge on the conductive layer 8 due to the photons having a wide range of energy can be suppressed. More preferably, the conductive layer 8, which includes at least three kinds of metals respectively selected one by one from each of the first to third groups, should be used. Accordingly, the charge on the conductive layer 8 due to the photons having a wider range of energy can be suppressed.

Figure 9A:
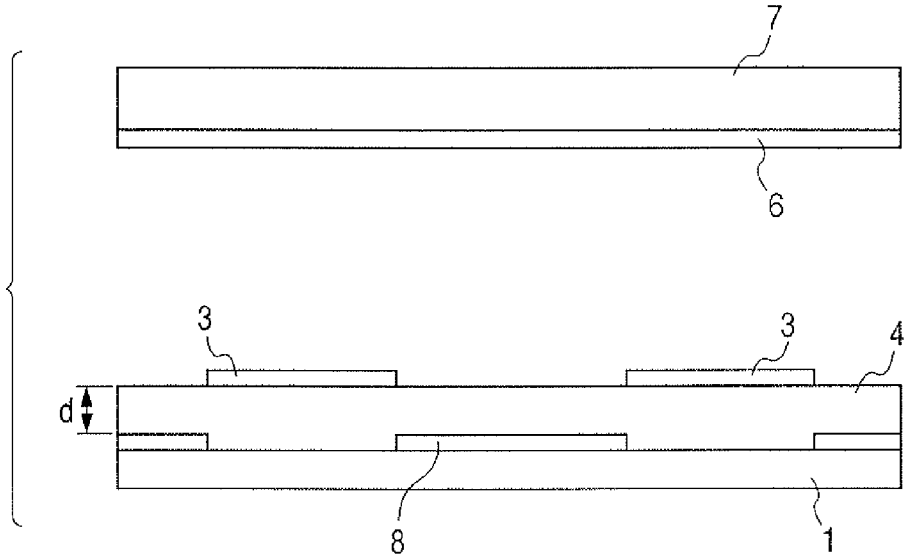
FIGS. 9A and 9B are views indicating an example of a shape of the conductive layer in the present invention.
Figure 9B:
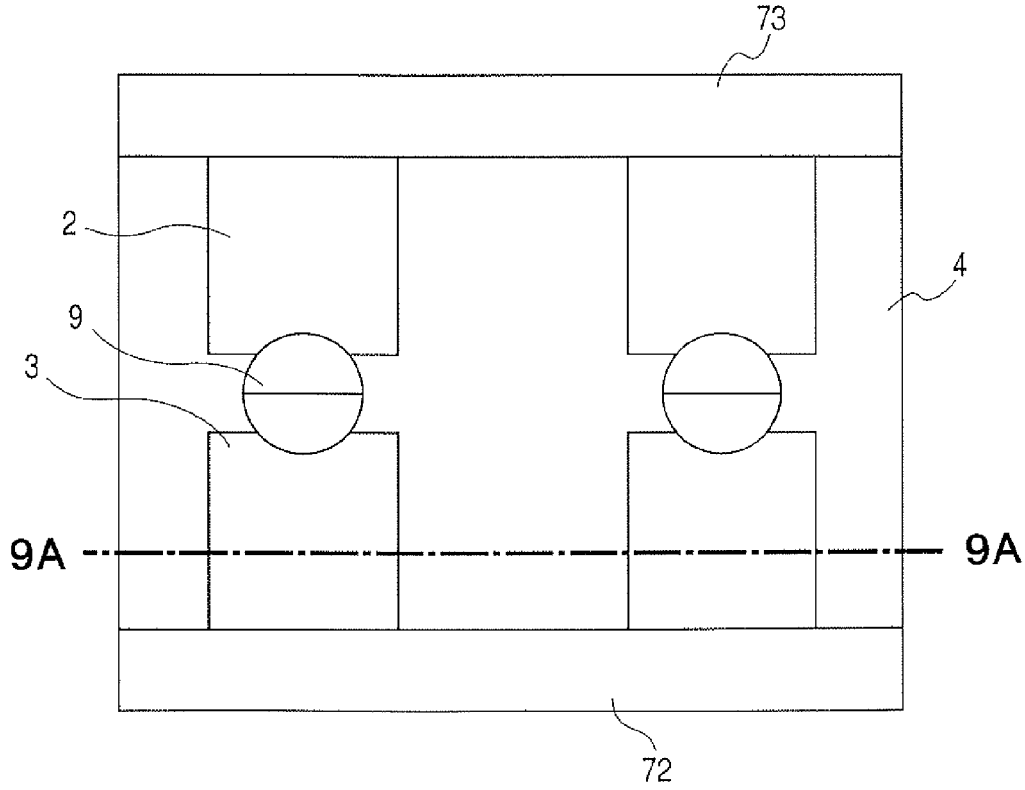

An example of the shape of the conductive layer 8 in the image display device of the present invention will be described with reference to FIGS. 9A and 9B. FIG. 9A is a cross-sectional view at a part of a dot line 9A-9A indicated in FIG. 9B, which is a partial plan view of the electron source observed from a side of the anode electrode 6. The same members as those described with reference to FIG. 1 are denoted by the same reference numerals in FIG. 1.

In the example described here, a surface-conduction electron-emitting device is used as the electron-emitting device. One edge of a conductive film 9 having a gap is connected to a first electrode 2 and the other edge of the conductive film 9 is connected to a second electrode 3. Wirings 72 and 73 are used to supply the potential to the electrodes 2 and 3. As the electron-emitting device which can be used in the image display device of the present invention, a well-known electron-emitting device such as the above-mentioned element of a field emission type, the element of an MIM (metal-insulator-metal) type or the element of a surface-conduction type can be used.

As the substrate 1, a quartz glass, a glass from which impurities such as Na and the like are reduced, a soda lime glass, a stack layer of stacking an oxide silicon on a silicon substrate by a sputtering method or an insulation substrate of ceramics such as alumina can be used.

As the material of the insulation layer, the anti-high electric field material, which can tolerate a high electric field, such as an oxide silicon, a silicon nitride, an aluminum oxide and a calcium fluoride are desirable. The insulation layer 4 can be formed by a general vacuum film formation method such as the sputtering method, a thermal oxidation method, an anode oxidation method or a coating method. In a case that a thickness d of the insulation layer is smaller, the capability of entering electrons into the insulation layer 4 from the conductive layer 8 increases. However, if the thickness is too thin, when the image display device is driven, the capacity between the electron-emitting devices (the electrodes 2 and 3) and the conductive layer 8 becomes large. Practically, the thickness is selected from a range of 100 nm to 10 μm. Preferably, it is selected from a range of 0.5 μm to 1.0 μm.

The materials of the electrodes 2 and 3 are properly selected from, for example, the metals or the alloy materials of Be, Mg, Ti, Zr, Hf, V, Nb, Ta, Mo, W, Al, Cu, Ni, Cr, Au, Pt and pd or the conductive materials of the semiconductors such as Si and Ge. As the material of the conductive film 9 having a gap, for example, the carbon, the metal or a mixture of them can be used. Electrons are emitted from the gap provided at a part of the conductive film 9 by applying the voltage between the electrode 2 and the electrode 3 through the wirings 72 and 73.

If the conductive layer 8 is arranged under at least one portion where a part of the insulation layer 4 is exposed, an effect of the present invention can be exhibited. However, in order to exhibit an effect of the present invention remarkably, it is desirable that the conductive layers 8, which carry out a role as the charge injection layer, are arranged under the all portions where the insulation layer 4 is exposed (portions where a surface of the insulation layer is not covered by the conductive members) as indicated in FIG. 9B. However, the conductive layer 8 may not be arranged under the portion, where the insulation layer 4 is exposed, existing on such a position deviating from a part just under the anode electrode 6 (an area opposite to the anode electrode). Typically, the conductive layer 8 may not be arranged under the insulation layer 4 which is on such the position deviating from an orthogonal projection area of the anode electrode 6 (an area just under the anode electrode 6).

In addition, in order to eliminate a problem about the above-mentioned capacity as much as possible, it is desirable that the conductive layer 8 is arranged only under the portion where the insulation layer 4 is exposed and the conductive members (the electrodes 2 and 3 and the wirings 72 and 73) provided on the insulation layer 4 are not to be overlapped with the conductive layer 8 between an upper part and a lower part. Note that the conductive layer 8 can be also arranged on an entire surface depending on values of the above-mentioned thickness d or a driving condition.

Figure 10A:
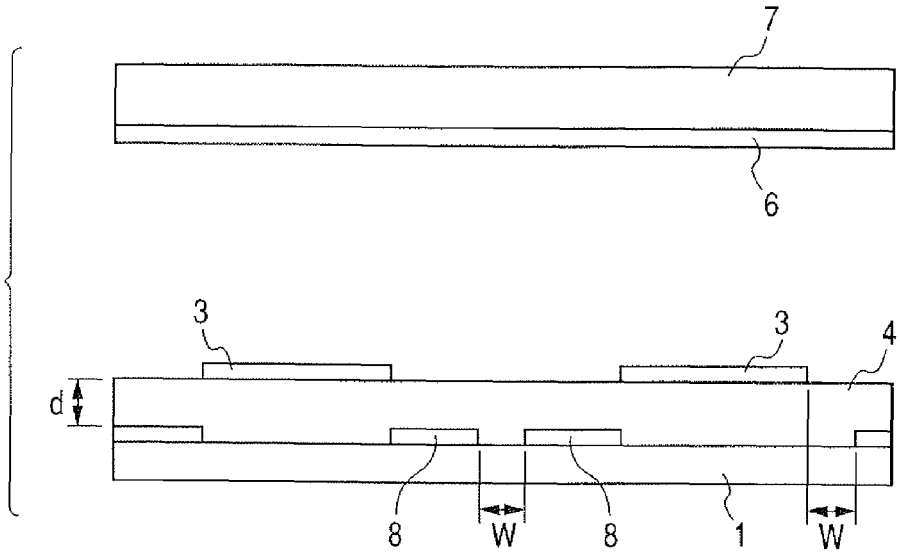
FIGS. 10A and 10B are views indicating another example of a shape of the conductive layer in the present invention.
Figure 10B:
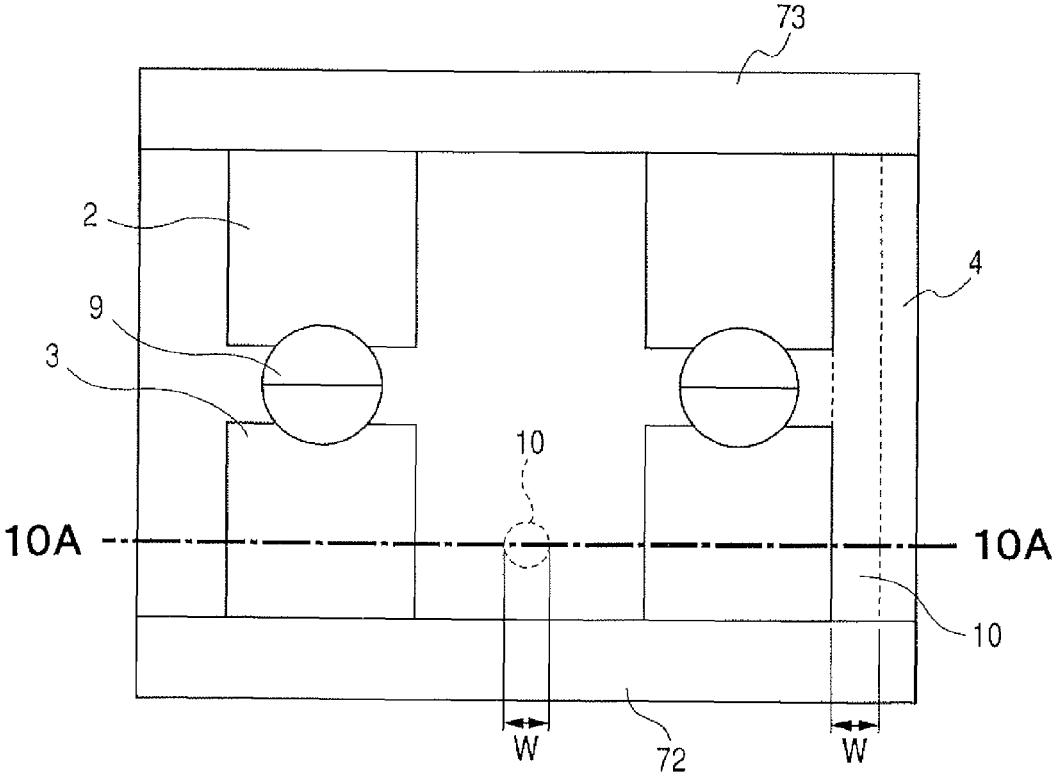

If there is a case that an area 10, where the conductive layer 8 does not exist, has to be provided just under an exposed surface of the insulation layer 4 within the orthogonal projection area of the anode electrode 6 as indicated in FIGS. 10A and 10B because of the convenience in a manufacturing process, it is desirable that a width W of this area is kept to become such a size equal to or less than 50 μm. When the width W becomes larger, an influence of the charge becomes more serious.

The conductive layer 8 in the present invention should just include the metals of the above-mentioned combination, besides, the metals themselves of the above-mentioned combination may become an alloy, and a state that blocks of the respective independent metal elements are mixed is allowed. Although the conductive layer 8 is preferably structured by only the metal of the above-mentioned combination, it is allowed that a main component, which structures the conductive layer 8, is the metal of the above-mentioned combination. (It is allowed that the mass, which is equal to 50% of the conductive layer 8, is occupied by the metal of the above-mentioned combination.)

In addition, the stack member structured by stacking layers of the respective metals of the above-mentioned combination can be also used as the conductive layer 8. However, in case of structuring the conductive layer 8 by the stack member, with respect to a thickness of the layers excepting the lowest layer (a layer located on the nearest side of the substrate 1), the thickness of the remained layers excepting the lowest layer must be set to become thinner (shorter) than an electron range R.

A forming method of the conductive layer 8 is properly selected from among the well-known methods that are a general vacuum film formation method such as the sputtering method or the like, a coating method of the organometallic solution, a CVD (Chemical Vapor Deposition) method, a dispersion coating method, a dipping method, a spinner method and an inkjet method.

In the present invention, the electron source can be structured by arranging plural pieces of electron-emitting devices. With respect to the arrangement of the electron-emitting devices, various arrangements can be adopted.

Figure 11:
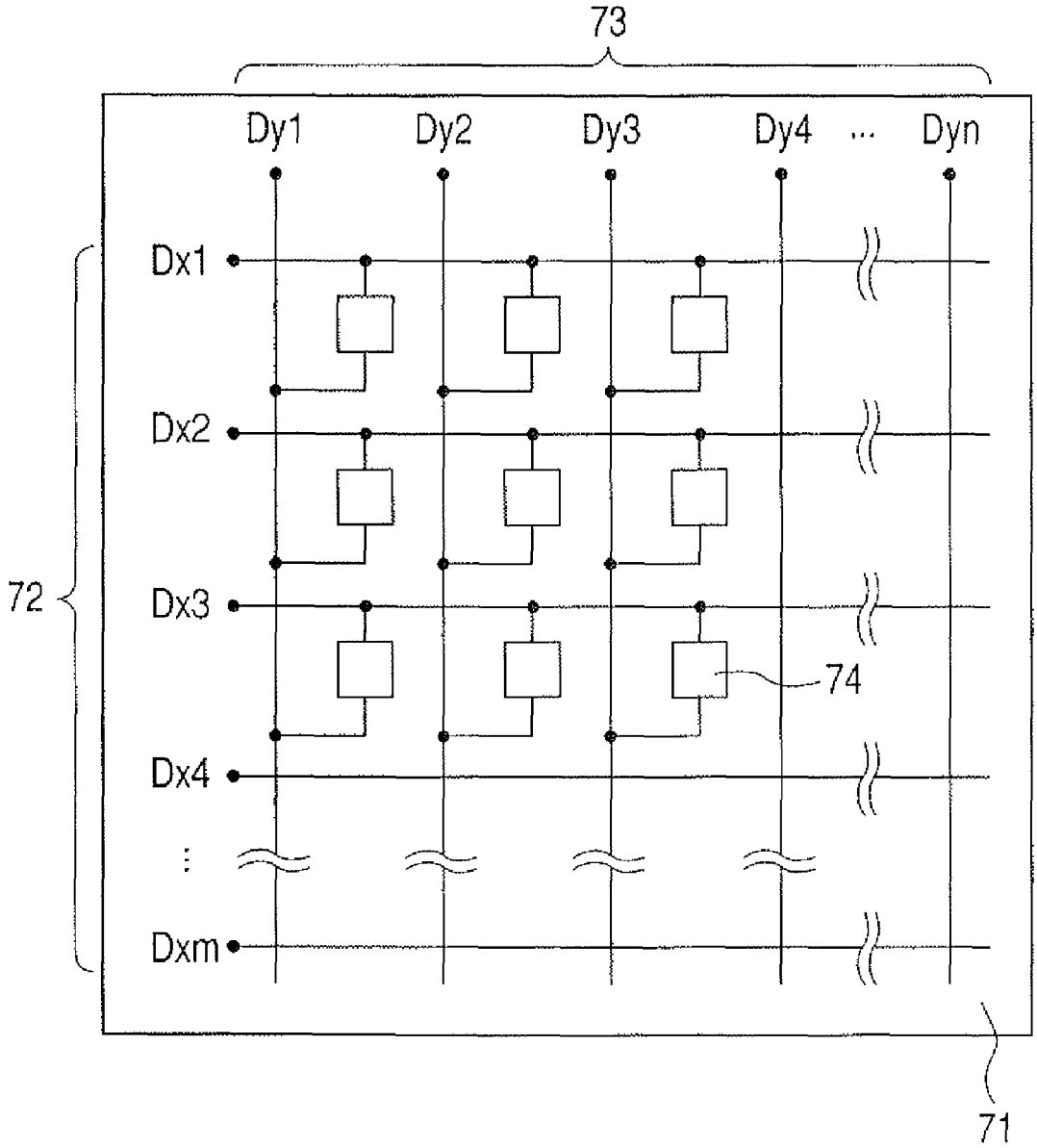
FIG. 11 is a schematic plan view of an electron source, on which electron-emitting devices are arranged in the shape of matrix.

A matrix arrangement that is an example of the arrangements of the electron-emitting devices will be described with reference to FIG. 11. In FIG. 11, a substrate (a rear plate) 71, the X-directional wirings 72, the Y-directional wirings 73 and an electron-emitting device 74 are illustrated. The plural electron-emitting devices 74 are arranged in the X-direction and the Y-direction in the shape of matrix, and the sides of electrodes of the plural electron-emitting devices 74 arranged on the same row are connected to one of the X-directional wirings 72 in common and the other sides of electrodes of the plural electron-emitting devices 74 arranged on the same column are connected to one of the Y-directional wirings 73 in common.

The X-directional wirings 72 are composed of m wirings of $D_{x1}$, $D_{x2}$, . . . $D_{xm}$ and can be structured by the conductive metal which is formed by using a vacuum vapor deposition method, a printing method or the sputtering method. The material, thickness and width of the wirings are properly designed. The Y-directional wirings 73 are composed of n wirings of $D_{y1}$, $D_{y2}$, . . . . $D_{yn}$ and can be formed by the same manner as that in the X-directional wirings 72. Interlayer insulation layers (not shown), which are provided between these m X-directional wirings 72 and these n Y-directional wirings, separate both the wirings electrically (m and n are positive integers).

Figure 12:
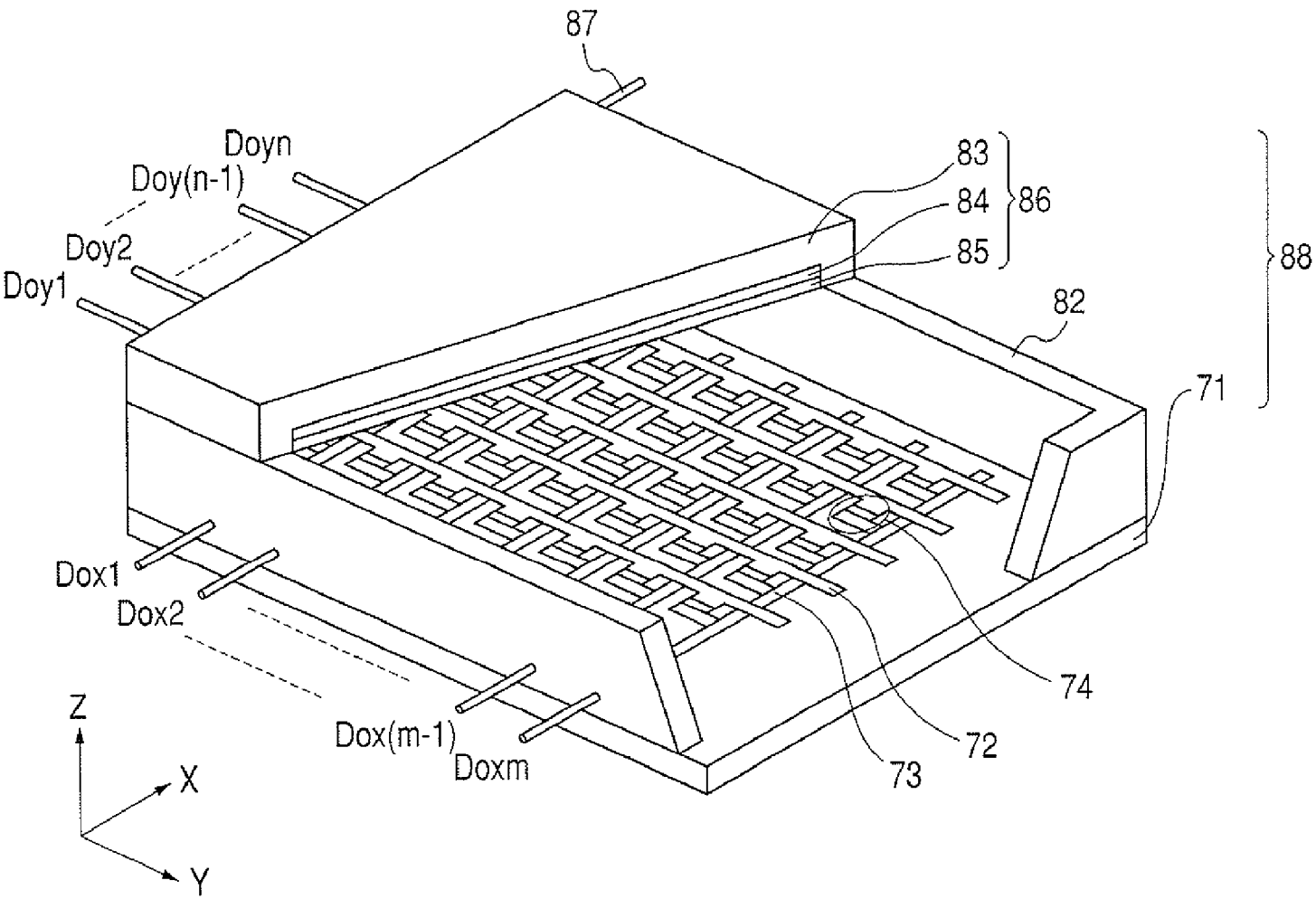
FIG. 12 is a schematic view illustrating an example of a display panel of an image display device using electron sources formed by the passive matrix arrangement.

An image formation device structured by using the electron sources formed by such the passive matrix arrangement will be described with reference to FIG. 12. FIG. 12 is a schematic view illustrating an example of a display panel of the image formation device. FIG. 12 illustrates the electron source substrate (rear plate) 71, a face plate 86 formed by a glass substrate 83 (of which the inner surface has a light emitter film 84 such as the fluorescent member), the film 84, and a metal back 85 that acts as the anode electrode, and also illustrates a support frame 82 to which the substrate (rear plate) 71 and the face plate 86 are adhered by using adhesive such as a frit glass, an envelope 88 of which the inside is maintained to become such the pressure lower than atmospheric pressure (preferably, it is a degree of vacuum equal to or larger than $10^{-7}$ Pa), the electron-emitting device 74, the X-directional wirings 72 and the Y-directional wirings 73 connected with a pair of electrodes (2 and 3) of the electron-emitting device.

Electrons are emitted from the electron-emitting devices 74 by applying the voltage to the respective electron-emitting devices 74 through the wirings 72 and 73. The high voltage of 5 kV to 30 kV (preferably, 10 kV to 25 kV) is applied to the metal back 85 through a high voltage terminal 87. The electrons emitted from the electron-emitting devices collide with the light emitter film 84 to emit the light and an image is displayed. Note that an interval between the face plate 86 and the substrate 71 is set to become a range of 1 mm to 5 mm, preferably, a range of 1 mm to 3 mm. By constituting in this manner, the electrons emitted from the selected electron-emitting devices transmit through the metal back 85 and collide with the light emitter film 84. Then, an image is displayed by exciting the fluorescent member and emitting the light.

An information display/reproduction device can be structured by using the envelope (display panel) 88 of the present invention described with reference to FIG. 12.

Concretely, this device includes a receiving device and a tuner for selecting a channel of the received signals, and signals included in the signals of the selected channel are output to the display panel 88 to display or reproduce information on a screen. The above-mentioned receiving device can receive broadcast signals such as the TV broadcast signal. As the signals included in the signals of the above-mentioned selected channel, at least one of video information, character information and audio information is designated. Note that it can be said that the above-mentioned "screen" corresponds to the light emitter film 84 in the display panel 88 illustrated in FIG. 12. By this structure, the information display/reproduction device such as a TV set can be structured. Of course, in a case that the broadcast signals are encoded, the information display/reproduction device of the present invention can also include a decoder. As to audio signals, those signals are output to an audio reproduction unit such as a speaker separately provided and reproduced synchronizing with the video information or the character information to be displayed on the display panel 88.

As a method of displaying and/or reproducing the video information or the character information on a screen by outputting the video information and the character information to the display panel 88, for example, it can be carried out as follows. First, image signals corresponding to respective pixels of the display panel 88 are produced from the received video information or the character information. And, the produced image signals are input to a drive circuit (C12) of the display panel (C11). Then, the voltage to be applied to the respective electron-emitting devices in the display panel 88 from the drive circuit is controlled based on the image signals which were input into the drive circuit, and an image is displayed.

Figure 13:
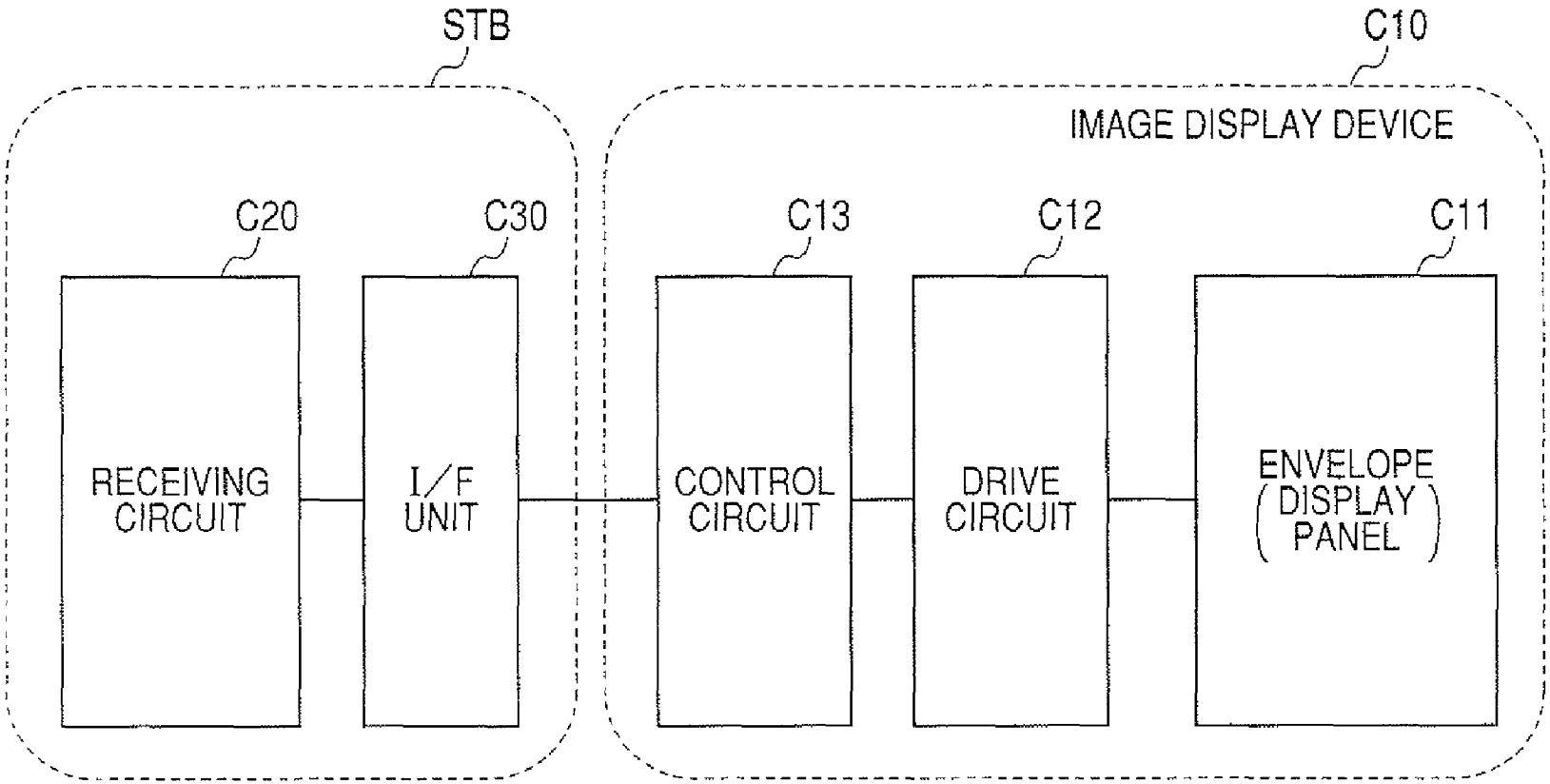
FIG. 13 is a block diagram of a television set adopting the present invention.

FIG. 13 is a block diagram of a TV set using the image display device of the present invention. A receiving circuit (C20), which is composed of a tuner, a decoder and the like, receives a satellite broadcast, TV signals such as a ground wave and a data broadcast via a network and outputs the decoded video data to an I/F (interface) unit (C30). The I/F unit (C30) converts the video data into a display format of the display device and outputs image data to the display panel (C11). The image display device (C10) includes the display panel (C11), the drive circuit (C12) and a control circuit (C13). The control circuit performs an image process such as a correction process suitable for the display panel to the input image data and outputs the image data and various control signals to the drive circuit (C12). The drive circuit (C12) outputs drive signals to respective wirings (refer to $D_{ox1}$ to $D_{oxm}$ and $D_{oy1}$ to $D_{oyn}$ in FIG. 12) of the display panel (C11) based on the input image data, and TV images are displayed. The receiving circuit (C20) and the I/F unit (C30) may be housed in another cage separating from the image display device (C10) as a set-top box or may be housed in the same cage as that of the image display device (C10).

It is also possible to structure that an image recording device or an image output device such as a printer, a digital video camera, a digital camera, a hard disk drive (HDD) and a digital versatile disk (DVD) can be connected to the interface. If it is structured in this manner, images recorded in the image recording device can be displayed on the display panel (C11). In addition, the information display/reproduction device (or TV set), which can process the images displayed on the display panel (C11) according to necessity and can output the processed images data to the image output device, can be structured.

EXAMPLES

Hereinafter, the present invention will be further described in detail by giving examples.

Example 1

The basic structure of a display device according to the example 1 and a manufacturing method of that device will be described with reference to FIG. 14.

<Process-a>

A conductive layer 8, of which thickness is 50 nm, composed of the three elements was formed on a cleaned glass substrate 1 by a co-sputtering method and a photolithography method by using the metal targets of Ni, Al and Pt.

<Process-b>

Next, as the insulation layer 4, the $SiO_2$ film of which thickness is 500 nm was formed by the sputtering method.

<Process-c>

Next, the electrodes 2 and 3 made from Pt were formed by the sputtering method and the photolithography method. An interval between the electrodes was fixed at 10 μm. Positions of the electrodes 2 and 3 are adjusted for the conductive layer 8, and the electrodes 2 and 3 were formed not to overlap with the conductive layer 8 as indicated in FIG. 14.

<Process-d>

Subsequently, a Pd film was formed on the substrate to which the Process-a to the Process-c were executed, and then a conductive film 9 was formed by performing a patterning process.

<Process-e>

Figure 14:
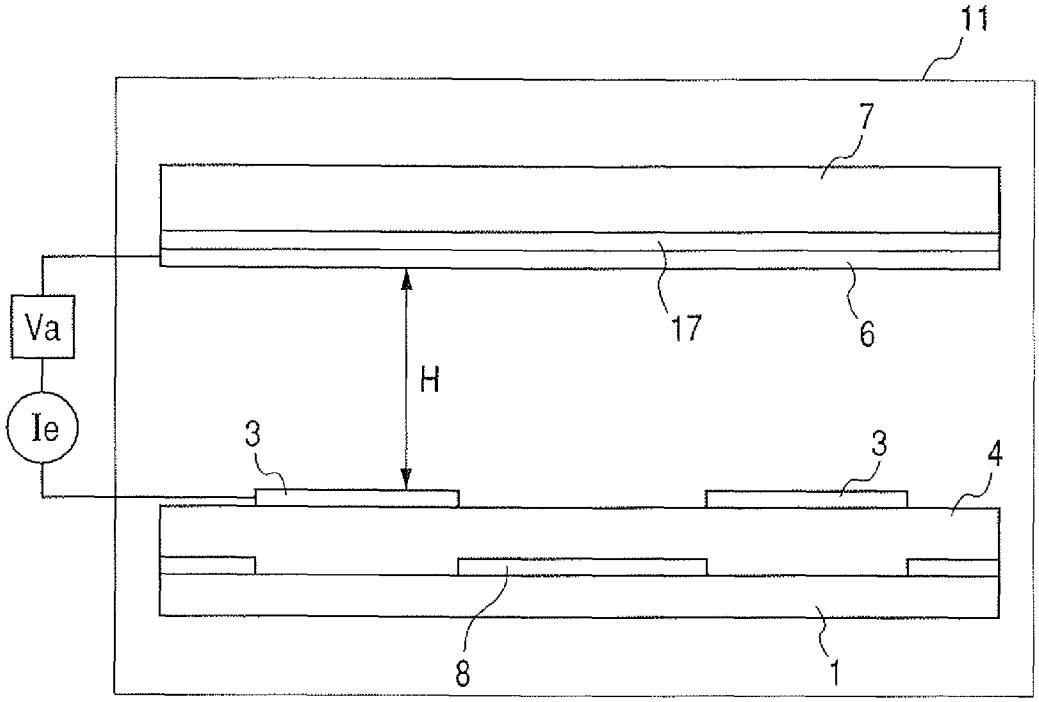
FIG. 14 is a schematic view indicating the basic structure of the example 1.

Subsequently, the substrate, to which the Process-a to the Process-d were executed, was arranged in a vacuum device 11 as indicated in FIG. 14, and the air was exhausted from the inside of that device 11 to reach a degree of vacuum equal to $1\times10^{-6}$ Pa. Thereafter, the voltage was applied between the electrode 2 and the electrode 3 by using a power source 12, and a gap was formed on a part of the conductive film 9. Successively, the well-known "activation" process was executed. According to the above processes, the electron-emitting device was formed.

<Process-f>

Subsequently, as indicated in FIG. 14, the substrate 7 having the anode electrode 6 was arranged. A light emission layer 17 was provided between the anode electrode 6 and the substrate 7. The material of Al film/Ti film was used for the anode electrode 6 illustrated in FIG. 14, and the light emission layer 17 was structured by the fluorescent member made from ZnS:CuAl. The pressure inside the vacuum device 11 was maintained to become a degree of vacuum equal to $1\times10^{-6}$ Pa.

In order to drive this display device, a distance H between the anode electrode 6 and the electron-emitting device is fixed at 2 mm, and the potential of 8 kV was supplied to the anode electrode 6 by a high-voltage power source (Va). In this state, when the driving voltage is applied between the electrode 2 and the electrode 3, an electron beam emitted from the gap enters into the anode electrode 6, and Ie was observed.

The electrons entered into the anode electrode 6 transmits through the anode electrode 6 and reaches the light emission layer 17, and then the light is emitted and the X-ray is generated. FIG. 7 indicates the energy distribution of the X-ray generated from the anode electrode and the fluorescent member when the electron beam was irradiated under a condition of the example 1. FIG. 8 indicates values of the δXe for the respective X-ray energy of the conductive layer 8 used in the example 1. As apparent from FIG. 8, the conductive layer 8 efficiently emits electrons depended on the photoelectric effect for the X-ray of the energy generated under the condition of the example 1.

The electrons depended on the photoelectric effect are flicked out from the insulation layer 4 by the X-ray generated from the anode side when this display device is driven. However, at the same time, electrons are entered into the insulation layer 4 from the conductive layer 8. Therefore, in this display device, the excellent electron emission characteristics could be kept for the driving for a long time without using an antistatic film which was usually required.

Example 2

Figure 15:
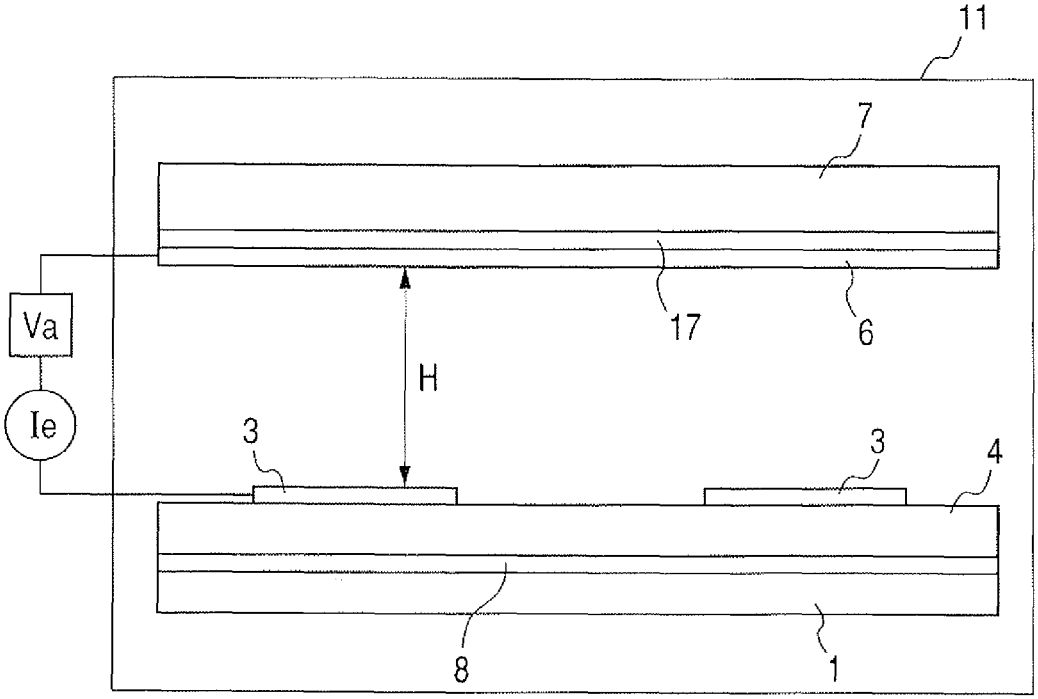
FIG. 15 is a schematic view indicating the basic structure of the example 2.

The example 2 will now be described with reference to FIG. 15.

<Process-a>

A conductive layer 8, of which thickness is 30 nm, composed of the two elements was formed on an entire surface of the cleaned glass substrate 1 by a co-sputtering method and a photolithography method by using the metal targets of Al and Pt.

<Process-b>

Next, as the insulation layer 4, the $SiO_2$ film of which thickness is 1 μm was formed by the sputtering method.

<Process-c>

Next, the electrodes 2 and 3 made from Pt were formed by the sputtering method and the photolithography method. An interval between the electrodes was fixed at 10 μm.

<Process-d> to <Process-f>

The substrate 1 having the electron-emitting devices was formed by the same methods as those in the process-d to the process-f of the example 1.

Subsequently, a device illustrated in FIG. 15 was structured. The material of Al film/Ti film was used for the anode electrode 6 illustrated in FIG. 15, and the light emission layer 17 was structured by the fluorescent member made from $Y_2O_2S$:Eu. Thereafter, the device was driven by the same manner as that in the example 1. Note that a potential of the conductive layer 8 was made to become a ground potential in the example 2. FIG. 5 indicates the energy distribution of the X-ray generated from the anode electrode and the fluorescent member when the electron beam emitted from the electron-emitting device was irradiated to the anode electrode 6 under a condition of the example 2. FIG. 6 indicates values of the δXe for the respective X-ray energy of the conductive layer 8 used in the example 2. As apparent from FIG. 6, the conductive layer 8 efficiently emits electrons depended on the photoelectric effect for the X-ray of the energy generated under the condition of the example 2.

The electrons depended on the photoelectric effect are flicked out from the insulation layer 4 by the X-ray generated from the anode side when this display device is driven. However, at the same time, electrons are entered into the insulation layer 4 from the conductive layer 8. Therefore, in this display device, the excellent electron emission characteristics could be kept for the driving for a long time without using an antistatic film which was usually required. However, as compared with the device in the example 1, the response speed of the electron emission is decreased. This is considered because the conductive layer 8 exists also just under the electrodes 2 and 3.

Example 3

Figure 16A:
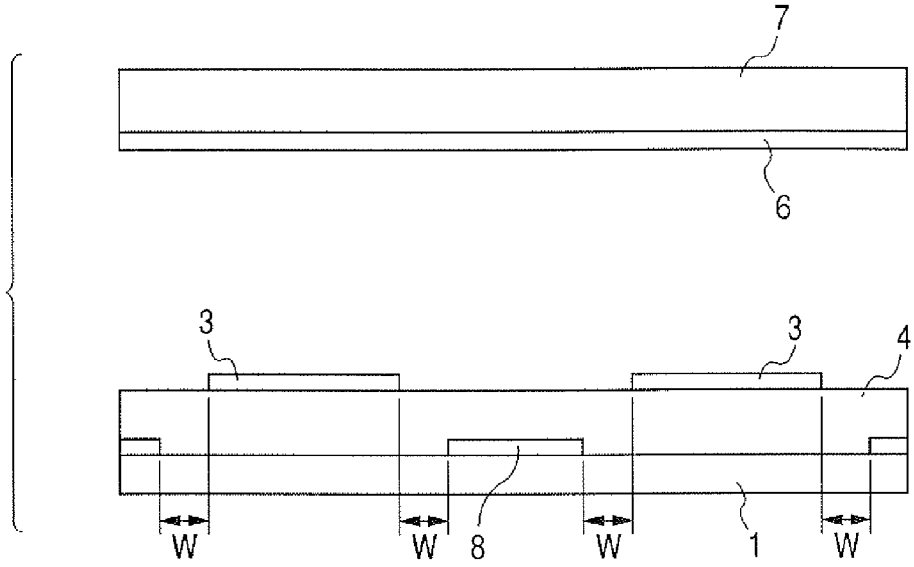
FIGS. 16A and 16B are schematic views indicating the basic structure of an example 3 of the present invention.
Figure 16B:
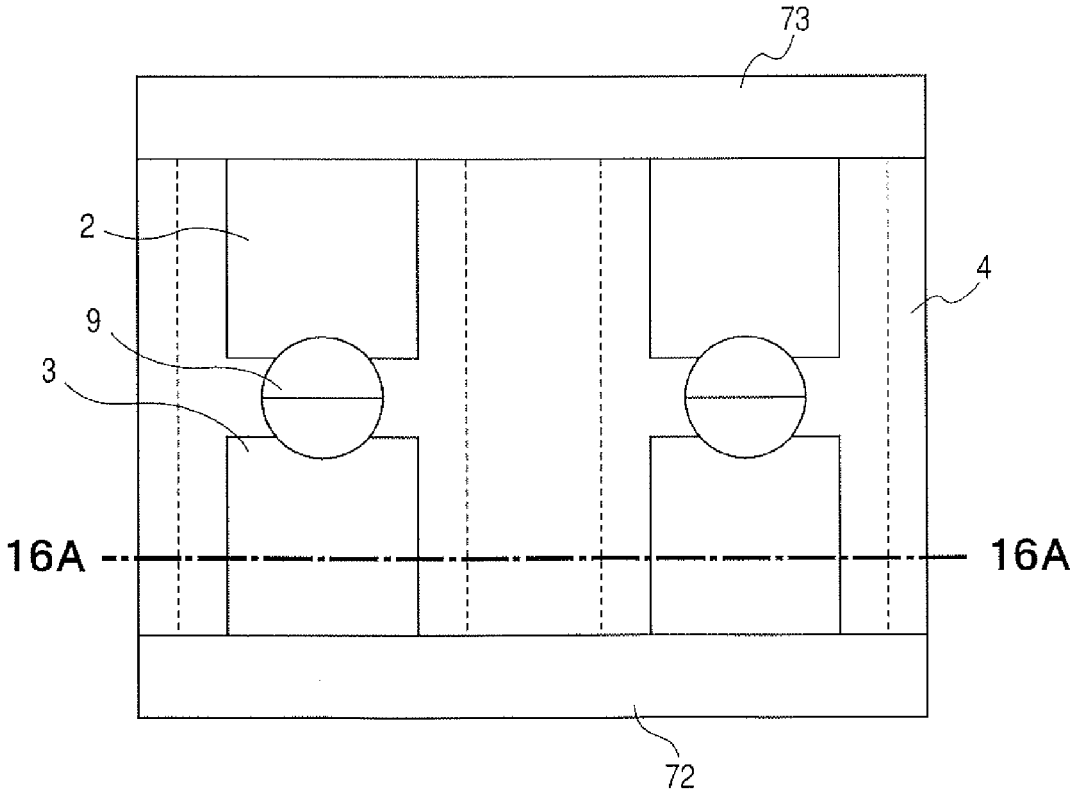

The example 3 will now be described with reference to FIGS. 16A and 16B. FIG. 16B is a plan view observing from an anode side in the example 3. FIG. 16A is a cross-sectional view at a part of a dot line 16A-16A indicated in FIG. 16B.

<Process-a>

A conductive layer 8, of which thickness is 30 nm, composed of the two elements was formed on an entire surface of the cleaned glass substrate 1 by a co-sputtering method by using the metal targets of Al and Pt. Thereafter, a patterning process is executed to the conductive layer 8 so that an interval of 10 μm is kept from an outer circumference of the electrodes 2 and 3 and the wirings 72 and 73, which are to be formed in the later processes.

<Process-b>

Next, as the insulation layer 4, the $SiO_2$ film of which thickness is 1 μm was formed by the sputtering method.

<Process-c>

Next, the electrodes 2 and 3 made from Pt were formed by the sputtering method and the photolithography method by performing a positional adjustment with the conductive layer 8 so that the positional relationship between the conductive layer 8 and the electrode becomes such the state, where an interval W is kept as indicated in FIGS. 16A and 16B. Here, the interval W indicated in FIGS. 16A and 16B is fixed at 10 μm, and an interval between the electrode 2 and the electrode 3 is fixed at 10 μm.

Thereafter, the device was manufactured by the same manners as those in the process-d to the process-f of the example 1. When driving the device, an excellent relationship between Ie and If can be kept for the driving for a long time, and the driving faster than that in the example 1 can be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-181283, filed Jun. 30, 2006, which is hereby incorporated by reference herein in its entirety.

What is claimed is:

1. An image display device comprising:

a light emission layer, and an anode electrode provided on the light emission layer;

an insulation member, and an electron-emitting device provided on the insulation member; and a conductive layer, wherein the anode electrode is opposed to the electron-emitting device, and electrons emitted from the electron-emitting device irradiate the anode electrode and the light emission layer, wherein the insulation member has an exposed surface opposite to the anode electrode, and at least a part of the exposed surface is positioned between the conductive layer and the anode electrode, wherein the conductive layer includes at least two kinds of metals, respectively selected from at least two groups among a first group consisting of metals belonging to the third period of the periodic table, a second group consisting of metals belonging to the fourth period of the periodic table, and a third group consisting of metals belonging to the fifth and sixth periods of the periodic table, wherein the anode electrode includes A1, wherein the light emission layer includes a fluorescent member mainly containing ZnS and a fluorescent member mainly containing $Y_2O_2S$, and wherein the conductive layer includes A1, includes at least one kind of metal selected from among Ni, Fe and Ti, and includes at least one kind of metal selected from Pt and Ta.

2. An image display device according to claim 1, wherein the insulation member includes an insulation substrate and an insulation layer having the exposed surface, and the conductive layer is arranged between the insulation substrate and the insulation layer.

3. An image display device according to claim 2, wherein the insulation layer is positioned between the conductive layer and the electron-emitting device, and a thickness of the insulation layer is 100 nm or more and 10 μm or less.

4. An image display device according to claim 2, wherein a conductive member including the electron-emitting device is provided on the insulation layer, and the conductive layer is arranged only between the insulation substrate and the exposed surface.

5. An image display device according to claim 1, wherein the insulation member includes an insulation substrate having the exposed surface, and the conductive layer is implanted into the insulation substrate.

6. An image display device according to claim 1, wherein the conductive layer includes at least three kinds of metals respectively selected from among the first group, the second group and the third group.

7. An information displaying and reproducing apparatus comprising:

a receiving device configured to receive a signal including at least one of video information and character information; and an image display device configured to display at least one of the video information and the character information, wherein the image display device is the image display device described in claim 1.

* * * * *